United States Patent [19]

Williams

[11] 4,113,092

[45] Sep. 12, 1978

[54] PACKAGING

[75] Inventor: Raymond Williams, Warrington, England

[73] Assignee: United Kingdom Atomic Energy Authority, London, England

[21] Appl. No.: 751,948

[22] Filed: Dec. 17, 1976

Related U.S. Application Data

[63] Continuation-in-part of Ser. No. 624,242, Oct. 20, 1975, abandoned.

[30] Foreign Application Priority Data

| | | | |
|---|---|---|---|
| Oct. 30, 1974 | [GB] | United Kingdom | 47013/74 |
| Jan. 17, 1975 | [GB] | United Kingdom | 2812/75 |
| Jun. 18, 1975 | [GB] | United Kingdom | 26017/75 |

[51] Int. Cl.[2] ..... B65D 85/66

[52] U.S. Cl. ..... 206/408; 206/412; 242/77.1; 53/429; 206/412

[58] Field of Search ..... 242/62, 77.1, 77.4; 206/389, 390, 408, 412, 395, 407; 53/14, 21 FW, 117, 118

[56] References Cited

U.S. PATENT DOCUMENTS

| | | | |
|---|---|---|---|
| Re. 21,516 | 7/1940 | Ross | 206/407 |
| 1,983,278 | 12/1934 | Flanigan | 206/407 |
| 2,134,918 | 11/1938 | Hendley | 206/412 |
| 2,811,248 | 10/1957 | Hill et al. | 242/77.1 |
| 2,853,185 | 9/1958 | Rollie | 206/407 |
| 2,922,206 | 1/1960 | Schmertz | 22/139 |
| 3,144,936 | 8/1964 | Muehlbach | 206/408 |
| 3,420,365 | 1/1969 | Bailey | 206/407 |
| 3,442,375 | 5/1969 | Hollingsworth | 206/412 |
| 3,564,707 | 2/1971 | Ensign | 29/605 |
| 3,645,386 | 2/1972 | Takaichi et al. | 117/6 |
| 3,674,222 | 7/1972 | Smiley | 242/77.1 |
| 3,797,647 | 3/1974 | Frishman | 242/77.1 |
| 3,856,141 | 12/1974 | Reed | 206/389 |

FOREIGN PATENT DOCUMENTS

| | | | |
|---|---|---|---|
| 598,710 | 5/1960 | Canada | 206/412 |
| 1,260,767 | 2/1968 | Fed. Rep. of Germany | 206/412 |
| 1,435,064 | 11/1968 | Fed. Rep. of Germany | 206/412 |

*Primary Examiner*—William Price
*Assistant Examiner*—Bruce H. Bernstein
*Attorney, Agent, or Firm*—Larson, Taylor and Hinds

[57] ABSTRACT

A package for pile fabrics in which individual turns of the fabric when coiled into a roll are separated and spaced apart by spacing means associated with a supporting strip releasably secured to one edge of the pile fabric. The turns of the supporting strip are bonded together to form a unified end structure.

13 Claims, 7 Drawing Figures

PACKAGING

CROSS-REFERENCES TO RELATED APPLICATIONS

This application is a continuation-in-part of application Ser. No. 624,242 filed Oct. 20, 1975, now abandoned.

BACKGROUND OF THE INVENTION

The present invention concerns packaging, in particular the packaging of fabrics which are prone to damage by crushing and creasing.

Certain fabrics such as pile fabrics can be damaged during transport and storage unless steps are taken to avoid crushing and creasing of the fabrics. When long lengths of fabric are involved problems arise in packaging as economics dictate that the packages should be as compact as possible to conserve transport and storage space. However compacting the fabrics can result in damage and rejection by the customer.

Means are known for packaging long lengths of fabrics, such as artificial furs, whereby each layer of the fabric is spaced from an immediately adjacent layer. Thus in order to protect the pile from being crushed or flattened during transport, it is known to hang the fabric on racks. The racks comprise an upright stand with regularly spaced arms radiating from the upper and lower ends thereof. Each arm is provided with spaced apart hooks which secure an edge of the pile fabric. The upper and lower edges of one end of the pile fabric are secured to the innermost hooks on the upper and lower arms. The fabric is then wound around in spiral fashion with the upper and lower edges being secured to the remaining hooks on the upper and lower arms. The hooks are so disposed that the pile fabric is coiled in a loose spiral configuration with a space between the surface of the pile and the back of the pile fabric forming the next adjacent loop in the spiral.

Such racks are expensive and cumbersome. In addition the coiling of the fabric is a laborious and time consuming operation.

The present invention seeks to provide a package which is robust and inexpensive to produce and adaptable to a variety of pile fabric thicknesses and lengths. In addition the invention seeks to provide a package which can readily be handled both by the manufacturer and the end user, occupies a minimum of storage space, presents a neat and attractive appearance and is easily disposed of after use.

SUMMARY OF THE INVENTION

A method of forming a package for pile fabrics which comprises releasably securing a supporting strip to at least one longitudinally extending edge of a length of pile fabric, providing spacing means on the supporting strip having a height greater than the nominal thickness of the pile fabric, applying a bonding agent to the strip and coiling the united strip and fabric into a roll to bond the turns of the coil to each other in a unified spacer strip structure.

DESCRIPTION OF THE DRAWINGS

The invention will be described further, by way of example, with reference to the accompanying drawings; in which.

DESCRIPTION OF THE PREFERRED EMBODIMENT

Figure 1:
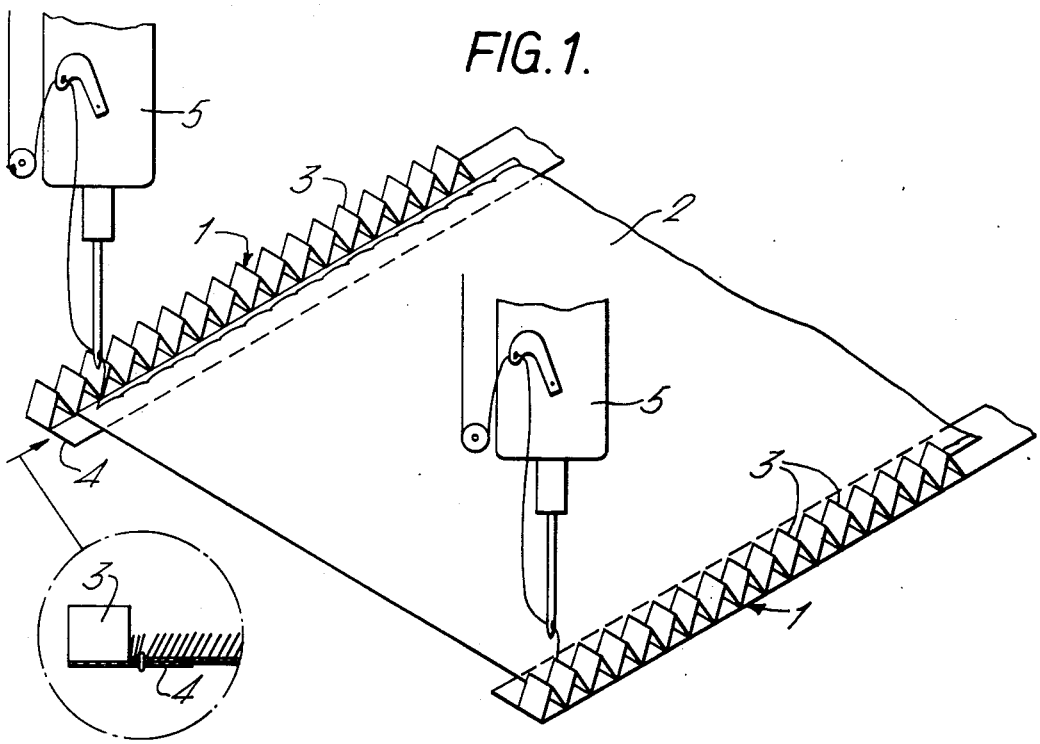
FIG. 1 illustrates diagrammatically a step in the formation of a package.

In FIG. 1, two spacer strips 1 are arranged substantially parallel and spaced apart by a distance determined by the width of a pile fabric 2. Each strip 1 has an elevated portion 3 and a base 4 of width greater than that of the elevated portion and forming a backing to support an edge of the fabric 2. The projecting base portions of the strips are directed towards each other. Conveniently the strips 1 can be formed from cardboard with the elevated portions 3 being constituted by corrugations. Thus, each strip 1 can be formed by adhesively securing a corrugated strip of cardboard to a plane strip of cardboard of greater width. However other materials and profiles can be used provided that the height of the elevated portion exceeds the nominal thickness of the pile fabric to be secured thereto.

Figure 2:
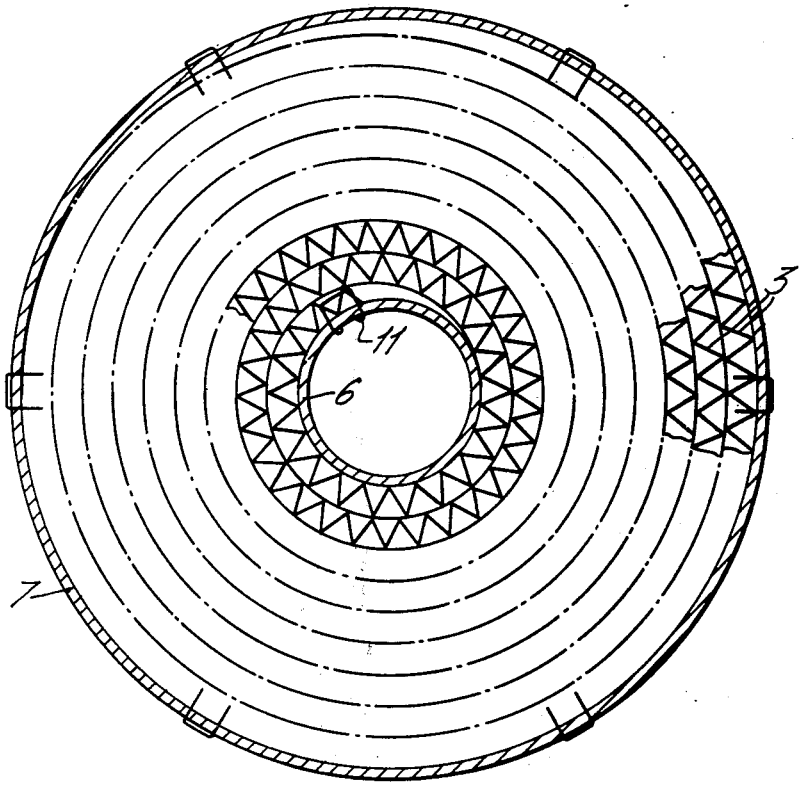
FIG. 2 is a section through a completed package.

The two strips 1 and the fabric 2 are run off supply rolls and progress together. The edges of the fabric are releasably secured to the projecting base portions 4 as by means of stitching. Two sewing heads 5 are shown in FIG. 1 and preferably the sewing heads secure the fabric edges to the base portions 4 by a readily releasable chain stitch. Upon leaving the sewing heads the united strips and fabric are coiled about a hollow former 6 (FIG. 2). Prior to engaging the former the under surfaces of the two strips, that is the surfaces of the portions 4 which do not contact the fabric, are treated with an adhesive.

The initial turn or coil is secured to the former by the adhesive. If required this initial turn or coil can be further secured by means of staples or the like. Thereafter, as the winding progresses to form a coiled package as shown in FIG. 2 having an Archimedean spiral configuration, the undersurface of each strip is adhesively secured to the exposed surfaces of the elevated portions of the immediately preceding turn or coil. On completion of the winding, the coil can be clad in an outer cover 7.

The cover 7, which can be stiff cardboard, can be secured to the strips 1 by adhesive, staples and the like or by a combination of such securing means. An adhesive tape can be employed to protect and cover the staples. Finally, annular end discs can be employed to protect the exposed ends of the coiled package. If required the completed package can be enclosed within a plastics sheath.

The hollow core provided by the former 6 enables a consumer to mount the completed package on a spindle or the like for drawing fabric from the roll. The outer cladding is removed to expose the fabric. The tacking at the exposed end of the fabric is released and the fabric can be drawn off as and when required.

As in the embodiment of FIGS. 1 and 2, the fabric is supported by the strips at each end of the roll it is possible to transport and store the roll in either horizontal or vertical positions.

FIGS. 3 to 6 illustrate a preferred and simplified embodiment of the invention in which a spacing strip is releasably secured to one longitudinal edge only of the pile fabric prior to coiling into a roll. In this embodiment the fabric is coiled in an upright condition with the spacer strips at the upper edge of the coils and the coils of fabric hang freely while being spaced apart.

Figure 3:
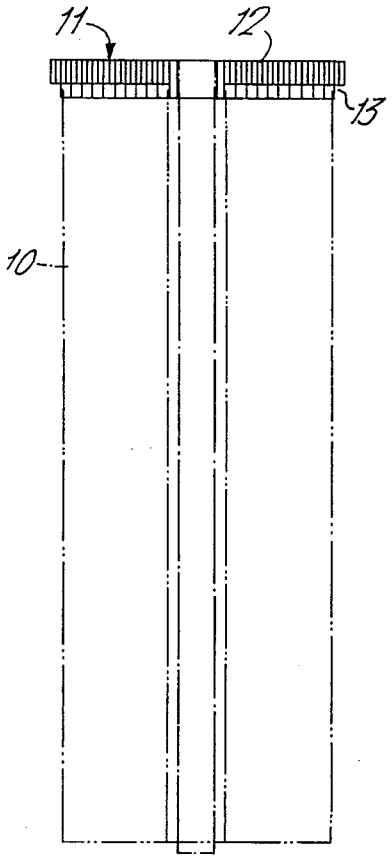
FIG. 3 illustrates diagrammatically a simplified form of package.

With reference to FIG. 3, a fabric 10 is releasably secured along one longitudinal edge as by stitching to a spacer strip 11. As in the case of the first embodiment the spacer strip 11 can be corrugated cardboard, the corrugations 12 defining the spacing between each turn or coil of the fabric with the edge of the fabric being releasably secured to a flange or base portion of the cardboard having a width greater than that of the corrugated portion. An adhesive can be applied to the undersurface of the base portion not contacting the edge of the fabric so that upon coiling the individual turns adhere one to the other to form a rigid disc.

Coiling of the fabric about a substantially vertical axis results in the package shown in FIG. 3. Each coil or turn of the fabric is separated from and out of contact with its immediately adjacent coil or turn as a result of the spacing strips. In FIG. 3 it is to be noted that the corrugated spacer strip is extended and continued about the outside of the end support disc to form a flange or lip 13.

Figure 4:
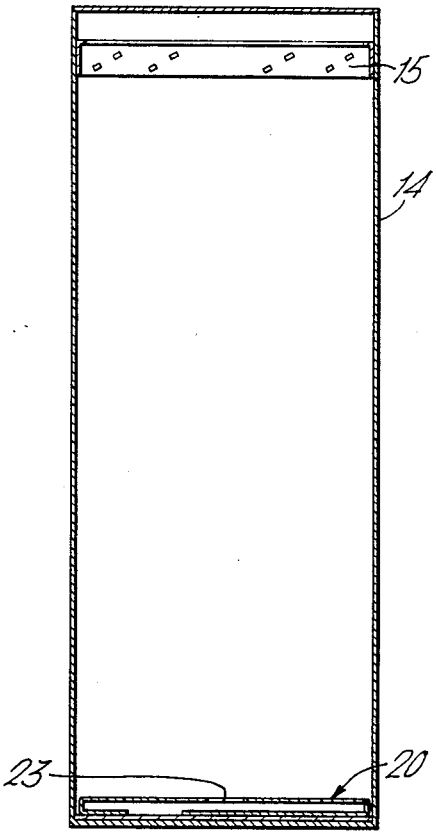
FIG. 4 illustrates a container for use with the package of FIG. 3.
Figure 5:
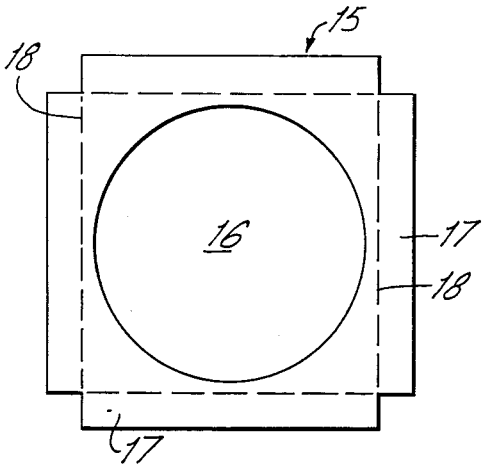
FIGS. 5 and 6 respectively illustrate top and bottom supports for supporting the package of FIG. 3 in the container of FIG. 4.

The package is received and stored within a rectangular box or container 14. FIG. 5 depicts a blank, conveniently formed from cardboard, for folding into a support for the coil of fabric within the container 14. The blank 15 has a circular cut-out 16 of a diameter such that it can be slipped over the length of the coiled fabric to abut against the flange 13 formed about the periphery of the end support disc. The edge tabs 17 along each side of the blank are folded along the dotted fold lines 18 into a plane normal to the plane of the blank. Upon folding of the tabs the blank is dimensioned to fit within the rectangular container. In FIG. 4, the blank 15 is shown positioned at the upper end of the container and it is secured to the walls of the container by means of staples or the like engaging the folded tabs. The blank when secured to the walls of the container supports the roll of fabric and it is positioned such that the fabric hangs freely with the bottom edge of the fabric clear of the base or bottom end of the container. By allowing the bottom edge of the coiled fabric to hang free above the bottom end of the container a space is provided beneath the fabric coil to accommodate any creep or extension of the fabric which can occur during storage. The required spacing between the individual coils of the package is provided by the spacer strip around the upper edge of the coiled fabric.

Figure 6:
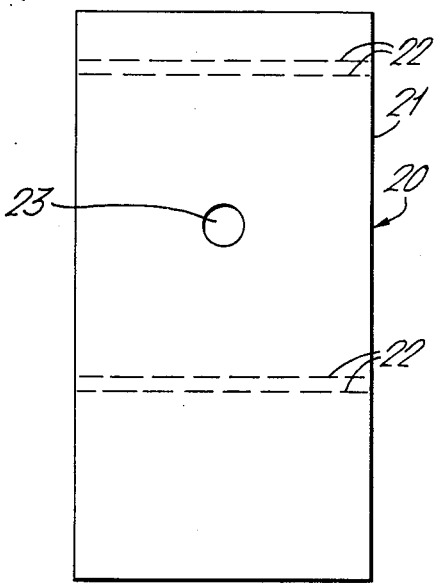

In the embodiment of FIGS. 3 and 4 it is not necessary to employ a central hollow former about which the fabric is coiled. However it is preferable to employ a former in order to provide lateral stability to the coiled fabric within the container. The lower end of the former can be located centrally at the bottom of the container by means of a support 20 formed from a blank 21 as shown in FIG. 6. Such a blank, which can be formed from cardboard, is folded about the fold lines 22 to form a seat having a central aperture 23 to receive the end of the former. The support 20 is situated at the bottom of the container as shown in FIG. 4.

In order to prevent the container being stood upside down it is possible to shape the exterior of the upper end of the container such that the container will become unstable if inadvertently stood on this end.

The spacing between individual coils of fabric can be varied by superimposing one or more spacing strips during assembly of the package. The depth of pile on artificial furs for example can vary with the quality and type of fur. It is desirable to be able to vary the height of the spacer strips to suit the particular fabric. This can be achieved by employing a plurality of spacer strips, each of a standard height. For example, with fabrics having a short pile a single spacer strip could serve to separate the coils when the fabric is wound into a package. With fabrics having a longer pile two or more superimposed spacer strips may be required to achieve the required spacing. The number of superimposed strips can be chosen to suit the particular fabric and the strips can be superimposed one upon the other before being brought into contact with the fabric. Thus a plurality of corrugated strips of cardboard can be superimposed one upon another to give the required spacing. Clearly it is not essential that the spacer strips are corrugated and other profiles and materials can be employed for the strips.

Figure 7:
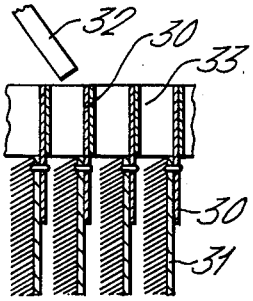
FIG. 7 illustrates diagrammatically a step in the formation of an alternative form of package construction.

As an example of alternative spacer strips reference is made to FIG. 7.

A supporting strip 30 which may be strong paper, cardboard or a plastics material, is releasably secured, as by stitching, to one longitudinal edge of a width of pile fabric. The fabric is secured along one edge of the strip leaving a major portion of the strip exposed and this exposed portion may be formed with a plurality of apertures, the apertures preferably being arranged in a random manner.

To form a package one end of the strip 30 is attached to a core 31 and the strip 30 and the fabric is wound onto the roll. As the strip is rolled onto the core an injection nozzle 32 injects plastics material onto the exposed portion of the strip secured to the fabric. Conveniently the plastics material is a foamed plastics such as foamed polyurethane or foamed polystyrene. The constituents of the selected foamed plastics material may be reacted in a chamber in communication with the nozzle 32 and the reaction is such as to force the plastics material through the nozzle and between the adjacent coils. The plastics material adheres to the supporting strip 30 and solidifies in a short time to provide a rigid spacer 33 between the coils of the package and to bond the coils to each other to form a unified spacer strip structure.

When the backing strip is apertured the plastics material flows through the apertures to form projections 34 on the outer surface of the roll. The height of the projections 34 is limited by placing a curved shoe 35 adjacent, but spaced a predetermined distance from, the outer surface of the roll. The predetermined distance is conveniently identical with the desired separation of the coiled strip in the completed package. As the coil is being wound the strip 30 contacts the projections 34 on the underlying coil and the void space between the coils is filled with plastics material from the nozzle 32. In addition to controlling the spacing between adjacent coils the projections 35 also serve to key with the plastics material issuing from the nozzle 32.

As the coiled package is produced the nozzle 32 and shoe 35 are moved outwards so that the plastics material is injected between the coils of the strip as they are coiled and so that the shoe 35 is maintained at the predetermined distance from the outer surface of the roll.

In FIG. 2, the fabric is releasably secured by stitching to a preformed spacer strip. Alternatively, the base portiion 4 can be first attached to the length of fabric and a spacer portion 3 is then bonded to the base portion 4, the fabric and the portions 3 and 4 being drawn off separate supply rolls. An adhesive is applied to the undersurface of the base portion 4 so that on coiling the individual turns are bonded together.

I claim:

1. A coiled package comprising:

a coiled supporting strip;

a coiled pile fabric releasably secured to the coiled supporting strip along at least one longitudinally extending edge of the pile fabric such that a portion of said strip extends outwardly beyond said edge along the length of said edge;

spacing means comprising an elongate member having a height greater than the nominal thickness of said pile fabric secured to said portion of said strip and separating the turns of the coiled supporting strip, a surface of each turn of said elongate spacing member being adjacent a surface of each turn of said portion of said strip; and a bonding agent between said surface of each turn of the elongate spacing member and the adjacent surface of each turn of said strip, said bonding agent being applied prior to coiling and bonding said surfaces together to form a unified spacer strip structure whereby the turns of the coil of fabric are separated and maintained apart by said spacer means.

2. A coiled package according to claim 1 wherein said fabric comprises a fur fabric.

3. A coiled package according to claim 1 wherein said supporting strip and said spacer member comprise cardboard.

4. A coiled package according to claim 1 wherein the spacing means comprise a plurality of superimposed corrugated cardboard strips.

5. A coiled package according to claim 1 wherein the spacing means comprises a plastics material.

6. A coiled package according to claim 1 further including a container for the coiled roll and means for supporting the roll in the container in which the supporting strip is releasably secured to the upper longitudinally extending edge only of the pile fabric and the coiled roll is supported in an upright condition within the container with the unitary spacer strip structure at the upper end of the container and with the bottom edge of the roll clear of the lower end of the container.

7. A method of forming a package for pile fabrics which comprises:

releasably uniting an elongate supporting strip to at least one longitudinally extending edge of a length of pile fabric such that a portion of said strip extends outwardly beyond said edge along the length of said edge;

providing spacer means comprising an elongate spacing member having a height greater than the nominal thickness of the pile fabric secured to said portion of said strip;

coiling the united strip and fabric into a roll with a surface of each turn of said elongate spacing member adjacent a surface of each turn of said portion of said strip; and providing a bonding agent between said surface of each turn of the elongate spacer member and the adjacent surface of each turn of said strip before said spacer member and strip are coiled into a roll such that upon coiling the united strip and fabric into a roll, said turns of the strip are bonded to one another in a unified spacer strip structure.

8. A method according to claim 7 wherein said strip and said elongate spacer member comprise cardboard.

9. A method according to claim 8 which comprises the further step of supporting the coil in an upright position within a package with the unitary spacer strip structure at the upper end of the container and with the bottom edge of the roll clear of the lower end of the container.

10. A method according to claim 9 wherein said fabric comprises a fur fabric.

11. A method according to claim 7 wherein said spacer means comprises a plurality of superimposed corrugated cardboard strips.

12. A method according to claim 7 wherein said elongate spacer member comprises plastic material.

13. A method according to claim 7 wherein said elongate supporting strip is releasably united to one edge only of said fabric.

* * * * *